US011413780B1

(12) United States Patent
Boyd et al.

(10) Patent No.: US 11,413,780 B1
(45) Date of Patent: Aug. 16, 2022

(54) AUTOMATED NONUNIFORM ENCLOSURE CUTTING TOOL

(71) Applicant: Securus Technologies, Inc., Carrollton, TX (US)

(72) Inventors: Kirkland M. Boyd, Dallas, TX (US); Geoffrey M. Boyd, Dallas, TX (US)

(73) Assignee: Securus Technologies, LLC, Carrollton, TX (US)

( * ) Notice: Subject to any disclaimer, the term of this patent is extended or adjusted under 35 U.S.C. 154(b) by 203 days.

(21) Appl. No.: 16/743,885

(22) Filed: Jan. 15, 2020

(51) Int. Cl.

| | |
|---|---|
| ***B26D 5/20*** | (2006.01) |
| ***B26D 7/01*** | (2006.01) |
| ***B26D 1/58*** | (2006.01) |
| ***B26D 1/00*** | (2006.01) |
| ***B26D 5/02*** | (2006.01) |
| *B26D 7/18* | (2006.01) |

(52) U.S. Cl.
CPC ..... *B26D 5/20* (2013.01); *B26D 1/0006* (2013.01); *B26D 1/58* (2013.01); *B26D 5/02* (2013.01); *B26D 7/01* (2013.01); *B26D 7/18* (2013.01); *B26D 2001/0046* (2013.01)

(58) Field of Classification Search
CPC ..... B26D 5/20; B26D 1/157; B26D 1/0006; B26D 1/58; B26D 5/02; B26D 7/01; B26D 7/02; B26D 7/025; B26D 7/18
See application file for complete search history.

(56) References Cited

U.S. PATENT DOCUMENTS 3,243,110 A * 3/1966 Kaser ..... G06G 1/12 235/78 R
3,311,025 A * 3/1967 Zankl ..... B23Q 1/25 409/80
3,630,111 A * 12/1971 Hartford ..... B23B 5/38 82/15
3,784,798 A * 1/1974 Beadle ..... G05B 19/4163 700/173
4,327,614 A * 5/1982 Klancnik ..... B23B 3/06 82/143
4,511,826 A * 4/1985 Kouchi ..... B23D 45/124 318/98
4,527,262 A * 7/1985 Manto ..... G11B 17/225 369/30.43
4,653,360 A * 3/1987 Compton ..... B23Q 1/52 82/18
4,688,973 A * 8/1987 Andert ..... B23B 29/03432 408/157
4,782,728 A * 11/1988 Thatcher ..... B23D 31/001 264/157

(Continued)

*Primary Examiner* — Sean M Michalski
(74) *Attorney, Agent, or Firm* — Fogarty LLP

(57) ABSTRACT

Embodiments are directed to an automated cutting tool that is configured to cut open nonuniform enclosures, such as cases containing electronic components. An example system comprises a multi-speed motor that is coupled to a cradle. The multi-speed motor rotates the cradle at a selected speed, and the cradle adapted to hold a case. A cutting head is positioned adjacent to the cradle and is configured to maintain contact with the case during rotation of the multi-speed motor. The multi-speed motor is configured to operate at a first speed when first segments of the case are in contact with the cutting head and to operate at a second speed when second segments of the case are in contact with the cutting head.

15 Claims, 7 Drawing Sheets

(56) References Cited

U.S. PATENT DOCUMENTS 4,802,156 A * 1/1989 Shyu ..... G11B 3/008 310/311
4,949,605 A * 8/1990 Geller ..... B23D 47/045 82/101
4,961,701 A * 10/1990 Barth ..... B65D 23/001 206/519
5,043,907 A * 8/1991 Richards ..... B23Q 15/12 700/167
5,072,399 A * 12/1991 Laws ..... G05B 19/186 700/187
5,101,699 A * 4/1992 Nezu ..... B23B 29/04 82/137
5,289,747 A * 3/1994 Wunderlich ..... B26D 5/20 83/54
5,376,770 A * 12/1994 Kuhl ..... B23K 26/04 219/121.69
5,400,260 A * 3/1995 Matsumura ..... G05B 19/40937 700/180
5,467,675 A * 11/1995 Dow ..... B24B 13/06 82/1.11
5,676,794 A * 10/1997 Baley ..... G03G 15/0894 156/510
5,751,586 A * 5/1998 Grabovac ..... G05B 19/184 408/13
6,274,841 B1 * 8/2001 Ramakrishnan ..... B23K 10/006 219/121.44
6,322,300 B1 * 11/2001 Santorius ..... H01R 13/6581 409/199
6,801,734 B1 * 10/2004 Jones, Jr. ..... G03G 15/0894 399/109
7,153,190 B2 * 12/2006 Mavro-Michaelis ... B24B 49/16 451/8
7,226,560 B2 * 6/2007 Dunlap ..... B26D 3/10 264/536
7,590,369 B2 * 9/2009 Wazana ..... G03G 15/0894 399/109
2004/0100218 A1 * 5/2004 Fujinawa ..... B23Q 15/013 318/571
2005/0151832 A1 * 7/2005 Martin ..... G03G 21/181 347/240
2006/0079987 A1 * 4/2006 Cha ..... G05B 19/4097 700/173
2006/0092674 A1 * 5/2006 Belton ..... A61B 17/1628 363/32
2008/0066596 A1 * 3/2008 Yamaguchi ..... B23K 26/38 83/34
2010/0088898 A1 * 4/2010 Thorson ..... B23D 21/04 30/95
2014/0109736 A1 * 4/2014 Schneider ..... B26D 1/40 83/13
2015/0298335 A1 * 10/2015 Perron ..... B26D 5/02 83/13
2015/0313097 A1 * 11/2015 LaTendresse ..... B23D 45/006 83/13
2016/0260278 A1 * 9/2016 Repp ..... B26D 7/28
2019/0299350 A1 * 10/2019 Sakai ..... B23Q 15/08
2019/0332069 A1 * 10/2019 Saitou ..... G05B 19/40935
2020/0174440 A1 * 6/2020 Morihashi ..... G05B 19/182

* cited by examiner

AUTOMATED NONUNIFORM ENCLOSURE CUTTING TOOL

BACKGROUND

Many different types of portable electrical devices contain internal components that must be shielded from the surrounding environment to prevent degradation or that must be enclosed in a housing to prevent tampering. The size and shape of such sealed cases are dependent on the components of the electrical devices. Components common to most devices include a battery and a circuit board that carries digital circuits, such as integrated circuit chips, a microprocessor, and/or analog circuit components. Such components may be housed in a rugged, weatherproof, factory-sealed, plastic case that is shock resistant and waterproof to ensure reliable functionality under normal atmospheric and environmental conditions.

Often such cases are sealed to prevent malicious tampering and/or unskilled repairs on the enclosed electronic components. Such cases may comprise two shells made of impact-resistant plastic that are non-releasably connected to each other using glue, epoxy, or welding, for example. When the electronic devices require refurbishment or maintenance, the case mush be safely cut open without damaging internal electronic components. Prior solutions involve cutting open the case with a hand-held saw. This is a slow, labor-intensive, inaccurate, and potentially dangerous process. In addition to the risk of bodily injury such as cutting oneself, significant fumes and plastic dust can be produced in the cutting process. A need exists to provide a means to quickly cut open electronics cases with minimal human intervention to save on labor costs and to improve workplace safety.

SUMMARY

Embodiments are directed to an automated cutting tool that is configured to cut open nonuniform enclosures, such as cases containing electronic components. In one embodiment, a system comprises a multi-speed motor that is coupled to a cradle. The multi-speed motor rotates the cradle at a selected speed, and the cradle adapted to hold a case. A cutting head is positioned adjacent to the cradle and is configured to maintain contact with the case during rotation of the multi-speed motor. The multi-speed motor is configured to operate at a first speed when first segments of the case are in contact with the cutting head and to operate at a second speed when second segments of the case are in contact with the cutting head.

The first and second segments may correspond to any features of the case. For example, the case may have an oblong shape, and the first segments are short sides of the case while the second segments are long sides of the case. Alternatively, the first segments may correspond to one or more sides of the case, and the second segments correspond to one or more corners of the case. In other embodiments, the second segments may correspond to sections of the case that are thicker than the first segments of the case.

The system may further comprise a trolley that is slidably mounted on a rail. The cutting head is attached to the trolley and is configured to move toward or away from the cradle as the cradle rotates and as different sides or edges of the case are presented to the cutting head.

The system may further comprise a spring element that is coupled to the trolley. The spring element is configured to apply a spring force on the trolley to move the trolley toward the cradle. The system may further comprise a flexible link that is coupled between a pulley and the trolley. The flexible link is configured to overcome the spring force when the pulley is rotated in a first direction. The flexible link configured to allow the spring force to move the trolley when the pulley is rotated in a second direction. The system may further comprise a servo motor that is coupled to the pulley. The servo motor is configured to rotate the pulley in the first or second direction in response to signals from a controller.

The system may further comprise a rotary motor and a flexible extension that is coupled between the rotary motor and the cutting head. The flexible extension is configured to transfer torque from the rotary motor and the cutting head. The flexible extension allows the cutting head to move toward or away from the cradle while the rotary motor maintains a fixed position.

The system may further comprise a guard that is coupled to the cutting head. The guard is configured to limit a cutting depth that is allowed when the cutting head contacts the case. For example, the cutting head may cut into the case sidewall until the guard touches the sidewall. The guard then prevents the cutting head from cutting any deeper into the sidewall.

The system may further comprise a controller that is configured to control the speed of a multi-speed motor based upon a current angular position of the multi-speed motor. The multi-speed motor may be a stepper motor that is configured to rotate at the first speed while rotating through a first range of angles of rotation and to rotate at the second speed while rotating through a second range of angles of rotation. The controller may comprise a processor and a memory for storing instructions that may be executed by the processor. The instructions, when executed by the processor, may cause the controller to command the multi-speed motor to rotate at the first speed when the current angular position corresponds to the first segments of the case, and then command the multi-speed motor to rotate at the second speed when the current angular position corresponds to the second segments of the case, wherein the first speed is faster than the second speed.

In another embodiment, a method comprises commanding a multi-speed motor to rotate a device at different speeds depending upon a current angular position of the device relative to a blade or other reference point. The multi-speed motor rotates the device at a first speed when the current angular position corresponds to first segments of the device and rotates at a second speed when the current angular position corresponds to a second segments of the device. The first speed and second speed are different, such as the first speed may be faster than the second speed. The multi-speed motor may be a stepper motor. The method further comprises cutting a sidewall of the device using a rotary blade while the device is rotating at the first or second speed.

The method may further comprise applying a positioning force to the rotary blade. The positioning force is configured to move the rotary blade toward the sidewall of the device. The method may further comprise applying a retraction force to the rotary blade. The retraction force is greater than the positioning force and is configured to move the rotary blade away from the sidewall of the device.

The method may further comprise driving the rotary blade at a first cutting speed when the current angular position corresponds to the first segments of the device and driving the rotary blade at a second cutting speed when the current angular position corresponds to the second segments of the device. The first segments may correspond, for example, to one or more sides of the device, and the second segments may correspond to one or more corners of the device. The second segments may correspond, for example, to sidewalls of the device that are thicker than the first segments of the case.

BRIEF DESCRIPTION OF THE DRAWINGS

Figure 1:
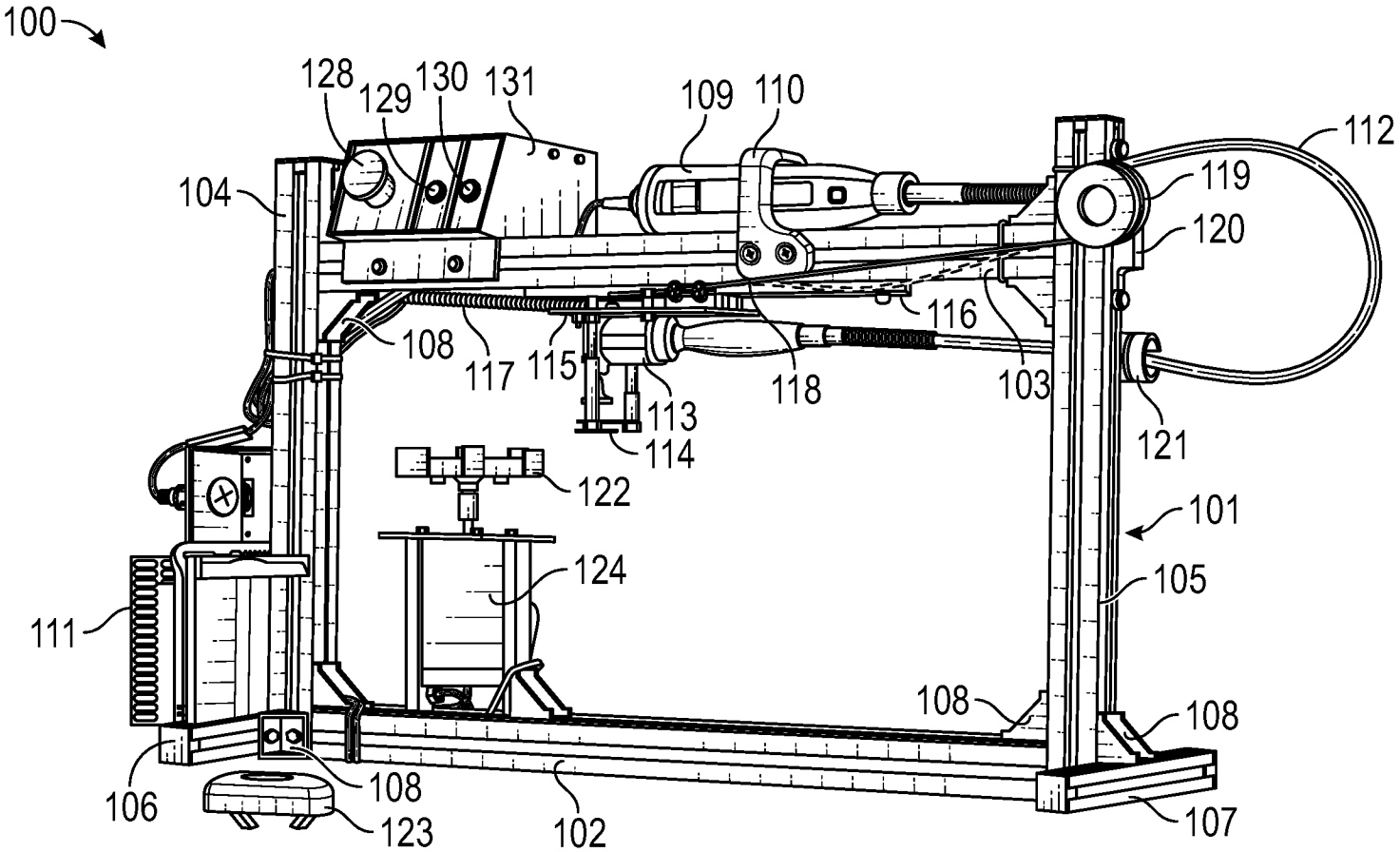

Having thus described the invention in general terms, reference will now be made to the accompanying drawings, which are not necessarily drawn to scale, and wherein:

FIG. 1 depicts an automated cutting tool according to an example embodiment.

Figure 2:
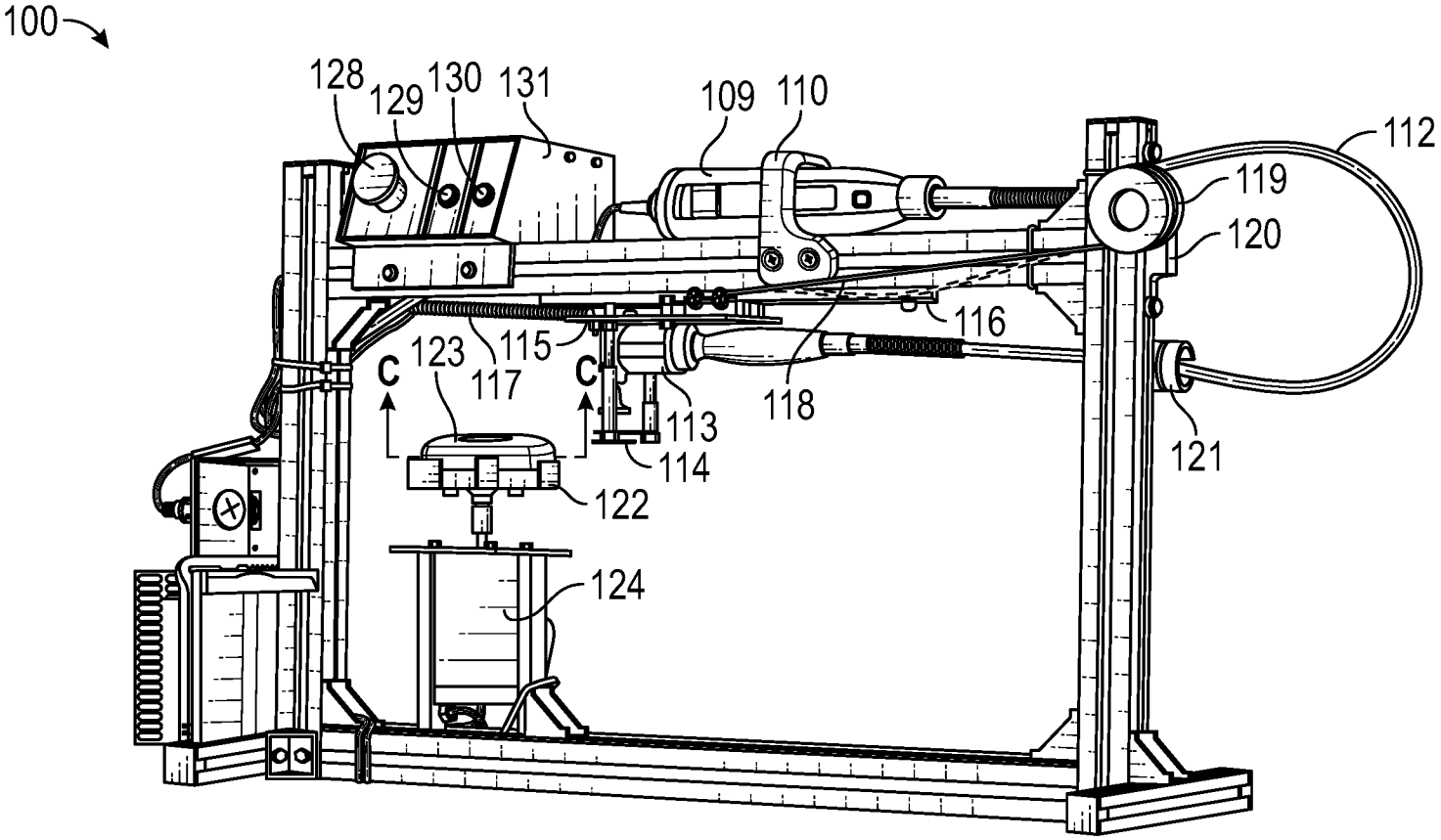

FIG. 2 illustrates a device mounted on a cradle while a trolley and cutting head are retracted out of the way.

Figure 3:
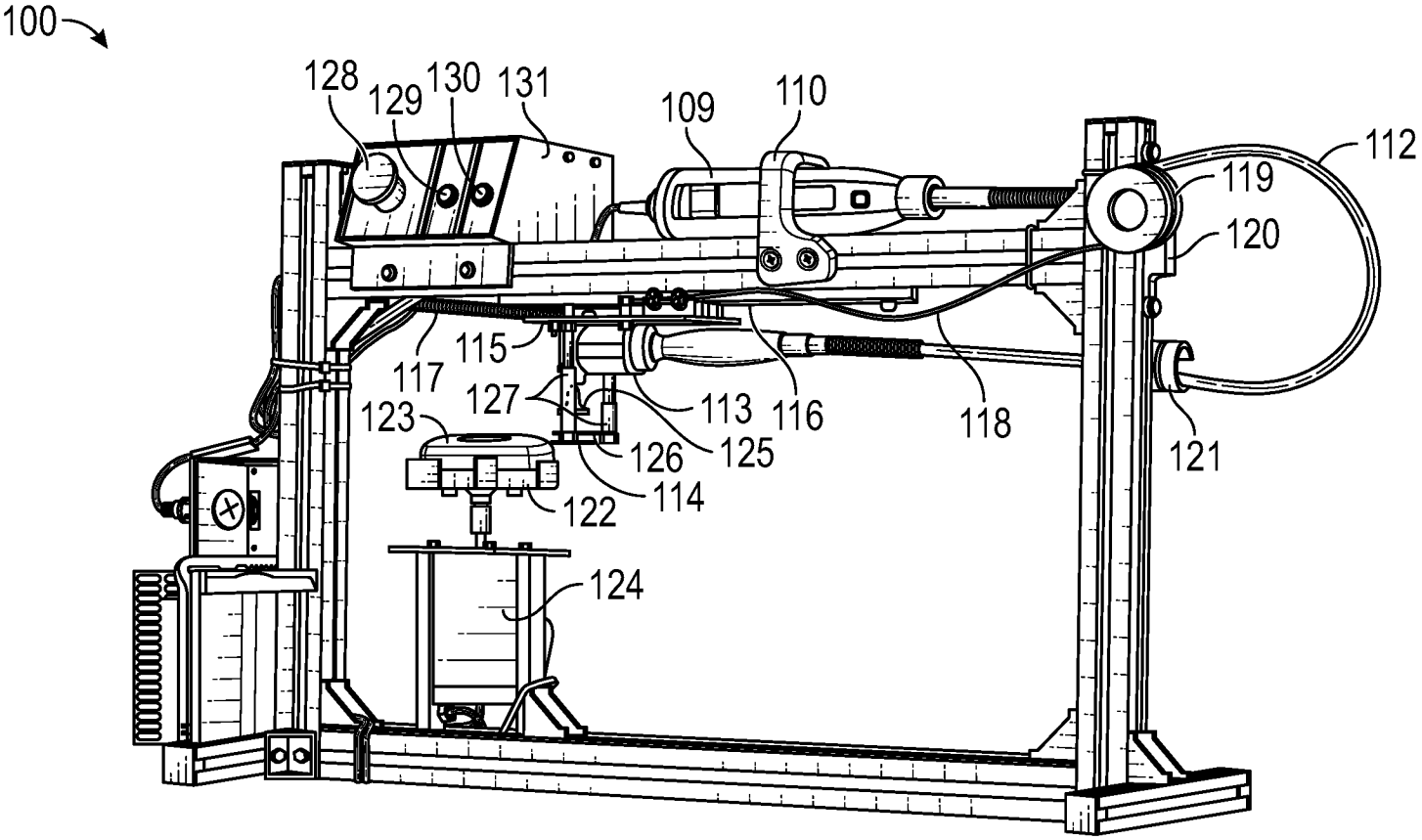

FIG. 3 illustrates the automatic cutting tool where the trolley and cutting head are no longer retracted out of the way.

Figure 4:
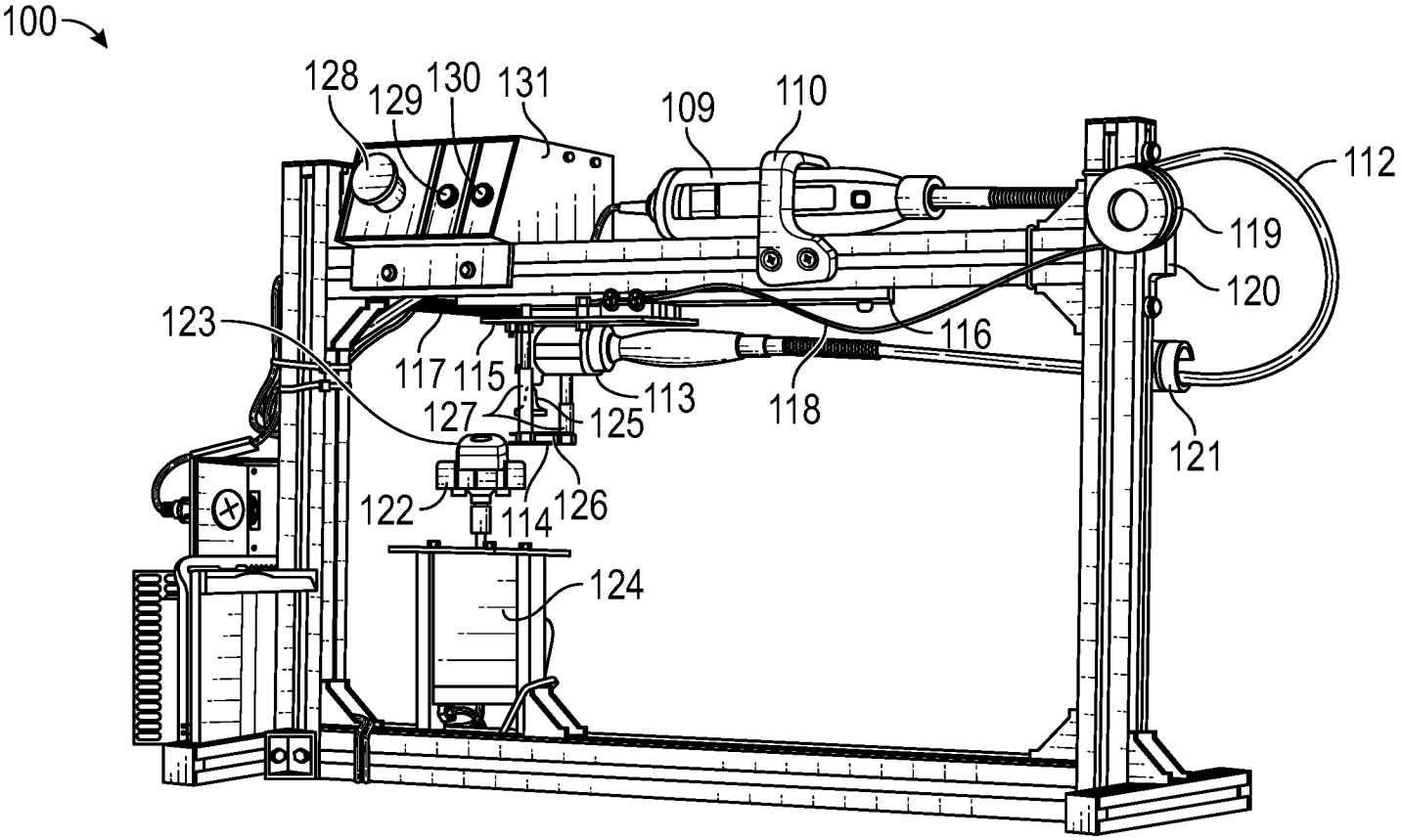

FIG. 4 illustrates the automatic cutting tool in operation after a stepper motor has rotated the cradle and device by 90 degrees from the position shown in FIG. 3.

Figure 5:
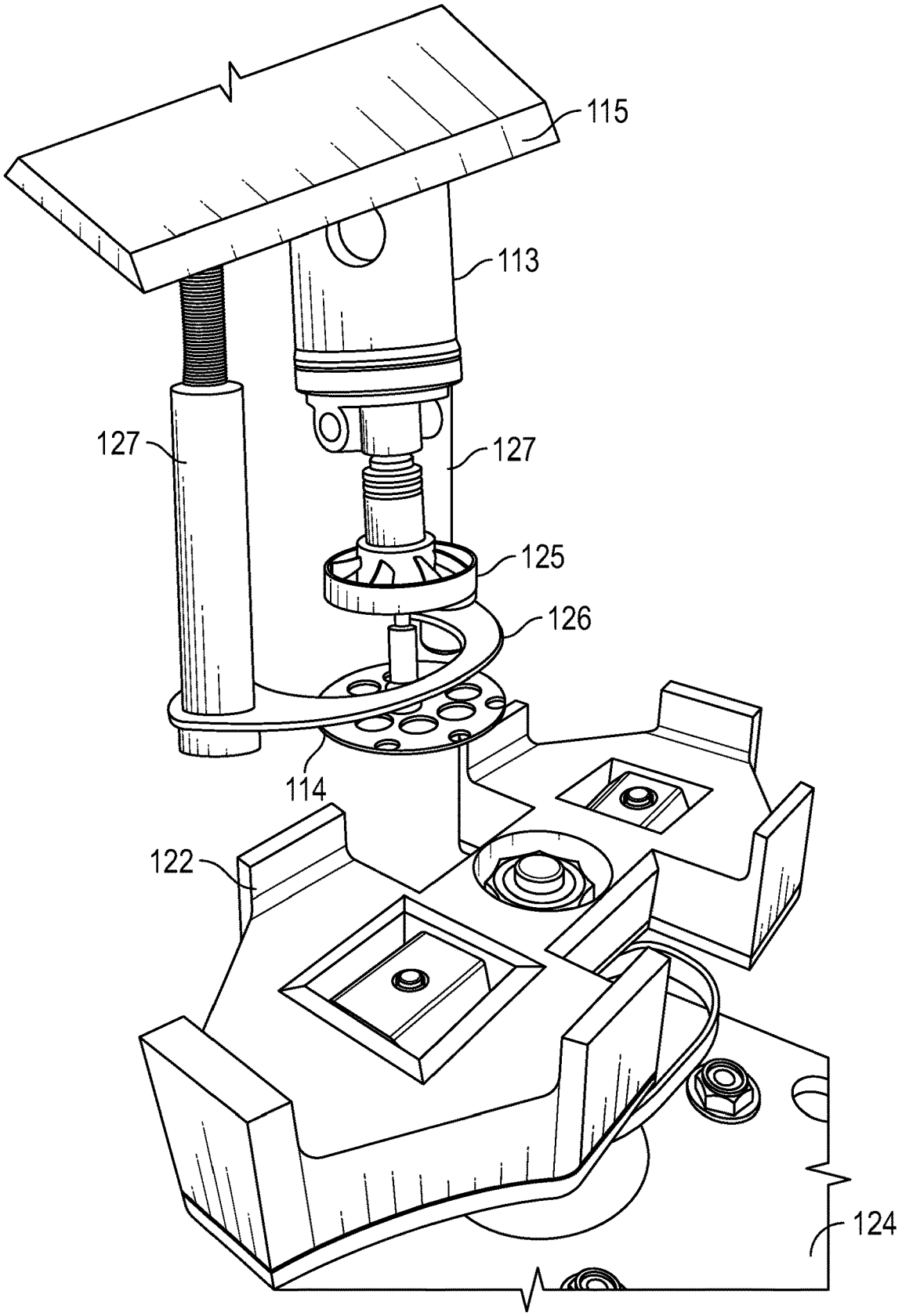

FIG. 5 is detailed view of the cutting head assembly of the automatic cutting tool.

FIGS. 6A-6D are top views of the cradle portion of the automatic cutting tool rotated through different positions.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

FIG. 1 depicts an automated cutting tool 100 according to an example embodiment. The automated cutting tool 100 comprises a frame 101, which may be constructed of aluminum or any other appropriate material. Frame 101 has a bottom rail 102 and a top rail 103, which is supported by two vertical supports 104 and 105. Base support legs 106 and 107 provide stabilization for frame 101. The bottom rail 102, top rail 103, vertical supports 104, 105, and base supports 106, 107 may be individual components that are joined by 90 degree corner brackets 108 as shown in FIG. 1 or may be parts of single frame device. The size and shape of the frame components may be selected based upon the size, weight, and desired positioning of the elements of the automated cutting tool 100. For example, one or more rails or supports may be configured to resist torque or other forces caused by rotating components.

Rotary tool 109 is attached to top rail 103 by bracket 110. Rotary tool 109 is an electronic tool powered by power supply 111 and may be single speed or variable speed. A flexible shaft extension 112 connects rotary tool 109 to a rotary right angle attachment 113, which drives a cutting head 114. Right angle attachment 113 and cutting head 114 are attached to a slidable cutting-head trolley 115 that moves along a linear rail system 116 mounted underneath top rail 103. The linear rail system 116 provides maximum rigidity to avoid cutting head jams caused by either the rotating platform or the cutting head twisting perpendicular to the blade angle.

The cutting head 114 is tensioned with a spring-loaded cam follower mechanism. A spring 117 applies a force to pull trolley 115 to the left in FIG. 1. A wire 118 couples trolley 115 to a pulley 119. A servo motor 120 drives pulley 119 counterclockwise to apply tension on wire 118, which exceeds the force of spring 117 and pulls trolley 115 to the right. Clip 121 holds flexible shaft extension 112 and allows for movement of extension 121 as trolley 115 moves.

Cradle 122 is adapted to securely hold a device 123 to be cut open by cutting head 114. In one embodiment, the device 123 may be an electronic apparatus, such as a Global Positioning System (GPS)-based monitoring device (e.g., ankle monitor), smartphone, or tablet, with a sealed plastic or metal case. Automatic cutting tool 100 is adapted to cut open the case quickly and without damaging internal electronics. Cradle 122 is attached to a stepper motor 124 that rotates cradle 122 during operation. Stepper motor 124 allows for precise control of angular position of cradle 122. In an alternative embodiment, a servo motor may be used instead of stepper motor 124 and feedback from the motor may be used to determine a current rotation position.

FIG. 2 illustrates device 123 mounted on cradle 122 while trolley 115 and cutting head 114 are retracted out of the way. Device 123 may be securely mounted on cradle 122 using bands, clamps, or other fasteners. Alternatively, the design of cradle 122 may be tightly fit to the form of device 123 so that device 123 securely "snaps into" cradle 122. Device 123 fits into cradle 122 so that a desired cut line C on device 123 will remain clear of cradle 122 and exposed to cutting head 114 as cradle 122 is rotated. When device 123 is mounted on cradle 122, stepper motor 124 may be turned on to rotate cradle 122 and device 123. Additionally, rotary tool 109 may be turned on so that cutting head 114 begins turning.

FIG. 3 illustrates automatic cutting tool 100 where wire 118 is no longer applying a force to move trolley 115 to the right. Tension on wire may be released if servo motor 120 allows pulley 119 to rotate freely or actively rotates pulley 119 clockwise. With the tension in wire 118 released, spring 117 pulls trolley 115 to the left so that cutting head 114 comes in contact with device 123 and begins cutting the case. The ideal blade used in cutting head 114 for a particular electronic device 123 case may be determined by testing to identify a blade that allows for high-speed cutting while limiting smoke and avoiding skipping and jamming. Similarly, rotary tool 109 may be selected based on efficiency, durability, and cost considerations.

FIG. 4 illustrates automatic cutting tool 100 in operation after stepper motor 124 has rotated cradle 122 and device 123 by 90 degrees from the position shown in FIG. 3 while continuing to cut the case. Spring 117 pulls trolley 115 to the left, which generally keeps cutting head 114 against device 123 during operation. While cutting the case on device 123, cutting head 114 generates heat that can be dissipated using fan 125, which is mounted on the same shaft as cutting head 114. Fan 125 spins with cutting head 114 and forces ambient air across cutting head 114 and the case of device 123. This reduces the temperature of the cut surface and prevents melting of the case and distortion of cutting head 114. Fan 125 also disburses smoke and fumes created during operation. Additionally, automatic cutting tool 100 may be operated on a vacuum table that allows for fumes and dust to be collected during use.

FIG. 5 is detailed view of the right angle attachment 113 and cutting head 114 that are attached to slidable cutting-head trolley 115. A blade guard 126 mounted on two posts 127 is attached to trolley 115 and positioned to limit the depth that cutting head 114 can penetrate device 123 when mounted on cradle 122. Blade guard 126 may be adjusted based on the type of device 123 that is being cut open to compensate for the case thickness on different devices.

Automatic cutting tool 100 may include one or more switches or other interfaces to control operation. For example, a system power switch 128 may control power to tool 100 and may also function as an emergency off switch. A spin control switch 129 may control the rotation of stepper motor 124 and cradle 122, while a cutter control switch 130 may control the rotary tool 109 and cutting head 114.

A control unit 131 may comprise a circuit board, application-specific integrated circuit (ASIC), or other control circuitry and/or software for controlling automatic cutting tool 100. Control unit 131 may control, for example, the speed and direction of rotary tool 109 and cutting head 114, the activation of servo motor 120, and the speed and direction of rotation for stepper motor 124. In one embodiment, the control unit 131 is custom coded to rotate stepper motor 124 at variable speeds depending upon the degree of rotation of the electronic device 123. Control unit 131 may further comprise foam or rubber dampening material (not shown) to compensate for frame vibration and to protect the circuit board and hand-wired components.

The speed of rotation of the electronic device 123 is not uniform. This is because testing has demonstrated that the cutting head 114 will skip past areas adjacent to the corners of the device if the rotation speed is not moderated. Even with a high tension applied by spring 117 to keep cutting head 114 against device 123, if the rotation speed is too fast, then the cutting head will bounce over the corners of the device 123 instead of making a constant cutting action.

In various embodiments, the rotary tool 109, flexible shaft extension 112, and rotary right angle attachment 113 may be commercially available products, such as DREMEL® tools and accessories available from Robert Bosch GmbH, or specialized or proprietary equipment that is manufactured for use in the automated cutting tool 100.

Figure 6A:
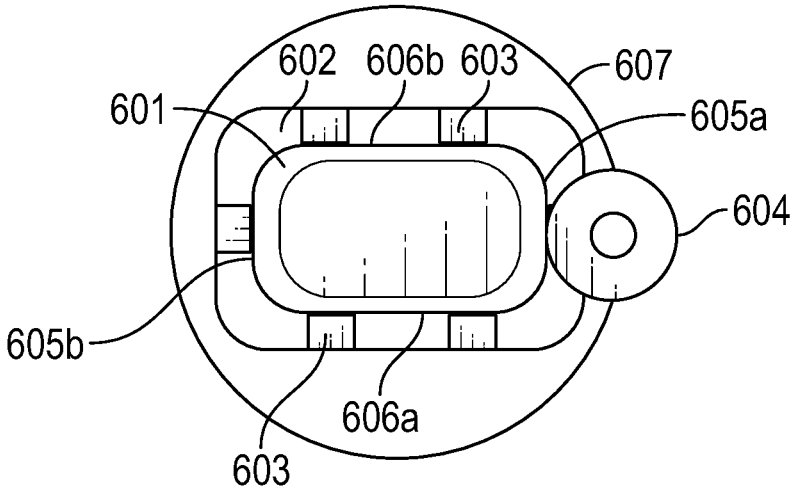

FIG. 6A is a top view of a portion of an automatic cutting tool according to an example embodiment. An electronic device case 601 is mounted in a cradle 602 and is held securely in place by various grips or stops 603. A cutting head or blade 604 is held against the side of case 601 by a spring (not shown). Blade 604 rotates at a constant speed and is configured to cut into case 601.

Case 601 has a generally oblong or rectangular shape with two short sides 605 and two long sides 606. Blade 604 is shown initially against a short side 605 of case 601. Stepper motor 607 rotates cradle 602 in a clockwise direction.

Figure 6B:
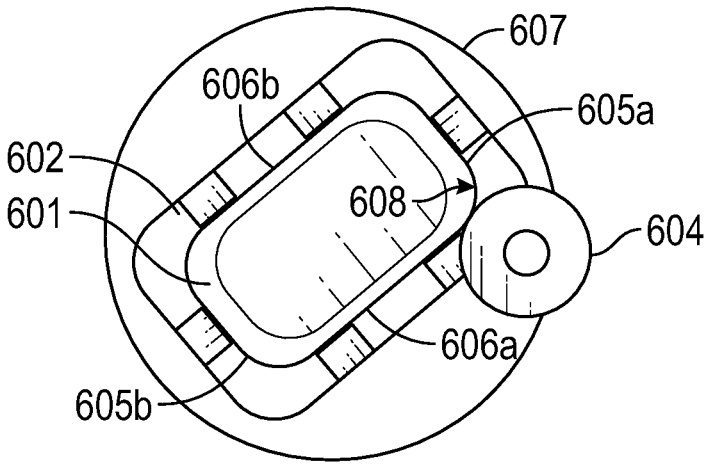

FIG. 6B illustrates the automatic cutting tool after cradle 602 has been rotated 45 degrees by stepper motor 607 from the position shown in FIG. 6A. Blade 604 has been pulled against the side of case 601 and continues to cut the case as it rounds the corner 608 between short side 605*a* and long side 606*a*.

Figure 6C:
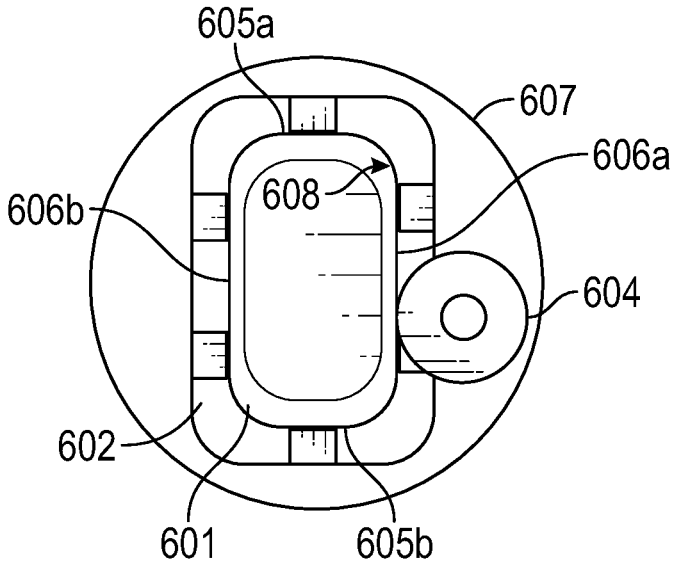

FIG. 6C illustrates the automatic cutting tool after cradle 602 has been rotated a further 45 degrees by stepper motor 607 from the position shown in FIG. 6B. Blade 604 is pulled against the side of case 601 and continues to cut the case along long side 606*a*.

Figure 6D:
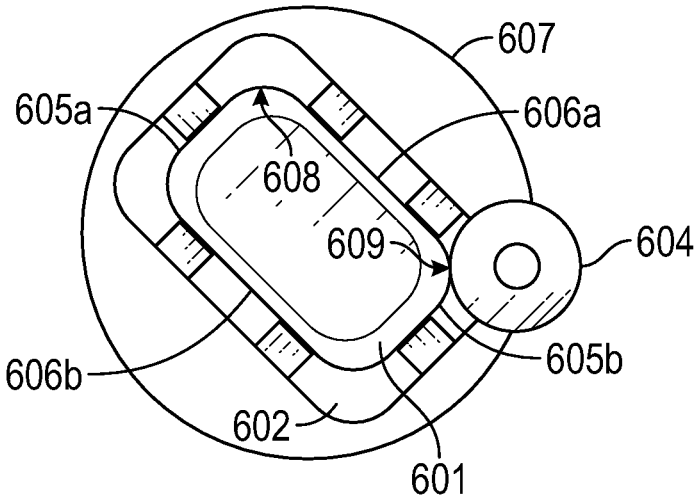

FIG. 6D illustrates the automatic cutting tool after cradle 602 has been rotated another 45 degrees by stepper motor 607 from the position shown in FIG. 6C. Blade 604 has been pulled against the side of case 601 and continues to cut the case as it rounds the corner 609 between long side 606*a* and short side 605*b*.

Stepper motor 607 rotates cradle 602 at two different speeds during operation of the automatic cutting tool. While cutting along short sides 605*a,b* and long sides 606*a,b*, the stepper motor 607 rotates cradle 602 and case 601 at a first, relatively high speed. However, when approaching the corners 608 and 609, stepper motor 607 slows down and rotates cradle 602 and case 601 at a second, relatively low speed. Once the cradle 602 and case 601 has turned past a corner 608 and 609 relative to blade 604, then stepper motor 607 resumes the first, high speed rotation until the next corner approaches blade 604.

Referring to FIGS. 6A-C, in one embodiment, stepper motor 607 is operating at a high speed in FIGS. 6A and 6C and is operating at a low speed in FIGS. 6B and 6D. In an alternative embodiment, if short sides 605*a,b* are very short so that the corners are close together, then stepper motor 607 may maintain the second, lower rotational speed along the short sides 605*a,b* instead of speeding up for a very brief period between corners.

In further embodiments, the rotational speed of blade 604 may also vary during operation. For example, blade 604 may spin faster when stepper motor 607 is rotating at a fast speed (i.e., along the sides of case 601), and blade 604 may spin slower when stepper motor 607 is rotating at a slow speed (i.e., around corners on case 601). This may be required in some embodiments to control heat generated by the cutting action and to manage temperature on case 601.

In other embodiments, the speed of stepper motor 607 (i.e., the rotational speed of case 601) and the speed of blade 604 may be dependent upon other features of case 601 instead of the locations of corners 608. For example, a particular case 601 may be thicker in some areas compared to others. The stepper motor 607 may slow down rotation of case 601 when blade 604 is cutting in these thicker areas and/or may increase the speed of blade 604 in the thicker areas in order to remove additional material. The speed of stepper motor 607 and the speed of blade 604 may also be varied based upon differences in case materials (e.g., different types of plastics, or combinations of plastics and metals in the case) or differences in case shape (e.g., varying degrees of angle between the cutting head and the case sidewall depending upon case rotation).

The speed of blade 604 and stepper motor 607 may be controlled using software or firmware instructions or other logic circuits stored in control unit 131, which sends signals to the rotary tool (109, FIG. 1) and/or the stepper motor 607 to command a desired rotational speed based upon the position of blade 604 relative to case 601. In some embodiments, the rotary tool and stepper motor may have two or more available speeds and the automatic cutting tool selects from the among the available speeds based upon the construction of case 601 (e.g., case material and shape).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

What is claimed is:

1. A system, comprising:

a multi-speed motor coupled to a cradle, wherein the multi-speed motor rotates the cradle at a selected speed, the cradle adapted to hold a case;

a cutting head positioned adjacent to the cradle and configured to maintain contact with the case during rotation of the multi-speed motor, wherein the multi-speed motor is configured to operate at a first speed when first segments of the case are in contact with the cutting head and to operate at a second speed when second segments of the case are in contact with the cutting head;

a trolley slidably mounted on a rail, the cutting head attached to the trolley and configured to move toward or away from the cradle;

a spring element coupled to the trolley, the spring element configured to apply a spring force on the trolley to move the trolley toward the cradle; and a flexible link coupled between a pulley and the trolley, the flexible link configured to overcome the spring force when the pulley is rotated in a first direction, the flexible link configured to allow the spring force to move the trolley when the pulley is rotated in a second direction.

2. The system of claim 1, further comprising:

a servo motor coupled to the pulley, the servo motor configured to rotate the pulley in the first or second direction in response to signals from a controller.

3. The system of claim 1, further comprising:

a rotary motor;

a flexible extension coupled between the rotary motor and the cutting head and configured to transfer torque from the rotary motor to the cutting head.

4. The system of claim 3, wherein the flexible extension allows the cutting head to move toward or away from the cradle while the rotary motor maintains a fixed position.

5. The system of claim 1, further comprising:

a guard coupled to the cutting head, the guard configured to limit a cutting depth allowed when the cutting head contacts the case.

6. The system of claim 1, wherein the multi-speed motor is a stepper motor that is configured to rotate at the first speed while rotating through a first range of angles of rotation and to rotate at the second speed while rotating through a second range of angles of rotation.

7. The system of claim 1, further comprising:

a controller configured to control the speed of a multi-speed motor based upon a current angular position of the multi-speed motor.

8. The system of claim 7, wherein the controller comprises:

a processor; and a memory for storing instructions that, when executed by the processor, cause the controller to:

command the multi-speed motor to rotate at the first speed when the current angular position corresponds to the first segments of the case; and command the multi-speed motor to rotate at the second speed when the current angular position corresponds to the second segments of the case, wherein the first speed is faster than the second speed.

9. The system of claim 8, wherein the first segments correspond to one or more sides of the case, and the second segments correspond to one or more corners of the case.

10. The system of claim 8, wherein the second segments correspond to sections of the case that are thicker than the first segments of the case.

11. A method, comprising:

commanding a multi-speed motor to rotate a device at a first speed when a current angular position corresponds to first segments of the device;

commanding the multi-speed motor to rotate at a second speed when the current angular position corresponds to a second segments of the device, wherein the first speed is faster than the second speed;

cutting a sidewall of the device using a rotary blade while the device is rotating at the first or second speed; and selectively applying one of:

a positioning force to the rotary blade, wherein the positioning force is configured to move the rotary blade toward the sidewall of the device; and a retraction force to the rotary blade, wherein the retraction force is greater than the positioning force and is configured to move the rotary blade away from the sidewall of the device.

12. The method of claim 11, further comprising:

driving the rotary blade at a first cutting speed when the current angular position corresponds to the first segments of the device; and driving the rotary blade at a second cutting speed when the current angular position corresponds to the second segments of the device.

13. The method of claim 12, wherein the first segments correspond to one or more sides of the device, and the second segments correspond to one or more corners of the device.

14. The method of claim 12, wherein the second segments correspond to sidewalls of the device that are thicker than the first segments of the case.

15. The method of claim 11, wherein the multi-speed motor is a stepper motor.

* * * * *